US011626682B2

(12) United States Patent
Yamaguchi et al.

(10) Patent No.: US 11,626,682 B2
(45) Date of Patent: Apr. 11, 2023

(54) CONNECTOR

(71) Applicant: Yazaki Corporation, Tokyo (JP)

(72) Inventors: Yasuhiro Yamaguchi, Shizuoka (JP); Kazuma Watanabe, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 72 days.

(21) Appl. No.: 17/386,164

(22) Filed: Jul. 27, 2021

(65) Prior Publication Data

US 2022/0037824 A1 Feb. 3, 2022

(30) Foreign Application Priority Data

Jul. 28, 2020 (JP) ..... JP2020-127214

(51) Int. Cl.
*H01R 13/405* (2006.01)
*H01R 13/11* (2006.01)

(52) U.S. Cl.
CPC ..... *H01R 13/405* (2013.01); *H01R 13/111* (2013.01)

(58) Field of Classification Search
CPC ..... H01R 13/405; H01R 13/111
See application file for complete search history.

(56) References Cited

U.S. PATENT DOCUMENTS 3,237,147 A * 2/1966 Elliott ..... G03B 15/041 439/348
3,636,495 A * 1/1972 Forsyth, Jr. ..... H01R 13/56 439/106
6,042,432 A * 3/2000 Hashizawa ..... H01R 13/187 439/843
6,254,439 B1 * 7/2001 Endo ..... H01R 13/187 439/846
6,692,278 B2 * 2/2004 Abadia ..... H02K 5/225 439/364
7,530,861 B2 * 5/2009 Nakamura ..... H01R 13/6633 439/694
8,342,893 B2 * 1/2013 Glick ..... H01R 13/187 439/840

(Continued)

FOREIGN PATENT DOCUMENTS

JP 2003-323921 A 11/2003
JP 2015-517177 A 6/2015

(Continued)

*Primary Examiner* — Neil Abrams

(74) *Attorney, Agent, or Firm* — Sughrue Mion, PLLC

(57) ABSTRACT

A connector includes a housing, a terminal, and an electric wire line. The housing is fittable to a mating housing that houses a mating terminal. The terminal is housed in the housing, and includes a tubular electric connection portion into which the mating terminal is inserted. The electric wire line includes at least a terminal end portion housed in the housing, and is electrically connected to the terminal. In the connector, the electric connection portion houses a multi-contact coil spring that is formed to have an elastically-deformable annular shape, is electrically connected to the electric connection portion, and is brought into contact at a plurality positions with the mating terminal inserted thereinto, and the terminal and at least the terminal end portion of the electric wire line are insert-molded in the housing.

5 Claims, 4 Drawing Sheets

(56) References Cited

U.S. PATENT DOCUMENTS

| | | | | |
|---|---|---|---|---|
| 8,430,698 | B2 * | 4/2013 | Stewart | H01R 13/187 439/843 |
| 9,484,641 | B2 * | 11/2016 | Ohkubo | H01R 13/187 |
| 10,062,974 | B2 * | 8/2018 | Okamoto | H01R 4/34 |
| 11,362,460 | B2 * | 6/2022 | Kitagawa | H01R 4/182 |
| 2012/0322322 | A1 | 12/2012 | Stewart et al. | |
| 2015/0050824 | A1 | 2/2015 | Blakborn | |
| 2019/0123497 | A1 | 4/2019 | Pfeiffer-Wagner | |
| 2022/0037824 | A1 * | 2/2022 | Yamaguchi | H01R 13/405 |

FOREIGN PATENT DOCUMENTS

| | | | |
|---|---|---|---|
| JP | 2016-6753 | A | 1/2016 |
| JP | 2016-207526 | A | 12/2016 |

* cited by examiner

CONNECTOR

CROSS REFERENCE TO RELATED APPLICATION

The present application is based on, and claims priority from Japanese Patent Application No. 2020-127214 filed on Jul. 28, 2020, the entire contents of which are incorporated herein by reference.

TECHNICAL FIELD

The present application relates to a connector.

BACKGROUND

JP 2016-207526 A discloses a connector including a sub-housing and a terminal. The sub-housing is a housing fittable to a mating housing that houses a mating terminal. The terminal is housed in the sub-housing, and includes a tubular electric connection portion into which the mating terminal is inserted. The connector includes an electric wire line that includes at least a terminal end portion housed in the sub-housing and is electrically connected to the terminal.

SUMMARY

However, in order to absorb tolerance at the time of fitting, in the connector, the housing is accommodated in a frame, and an alignment means is provided between the housing and the frame. Thus, the tolerance absorption structure requires the frame larger than the housing, which disadvantageously increases a size of the connector as a whole.

An object of the present application is to provide a connector capable of absorbing tolerance at the time of fitting and being reduced in size.

A connector according to an embodiment includes a housing fittable to a mating housing that houses a mating terminal, a terminal being housed in the housing and including an electric connection portion into which the mating terminal is inserted, the electric connection portion being tubular, and an electric wire line including at least a terminal end portion housed in the housing and being electrically connected to the terminal. The electric connection portion houses a multi-contact coil spring that is formed to have an elastically-deformable annular shape, is electrically connected to the electric connection portion, and is brought into contact at a plurality of positions with the mating terminal inserted thereinto. The terminal and at least the terminal end portion of the electric wire line are insert-molded in the housing.

A holding member including a holding portion may be assembled to the housing, the holding portion being inserted into the electric connection portion and holding the multi-contact coil spring in the electric connection portion.

The electric wire line may be drawn out from the housing in a direction intersecting with a fitting direction of the housing, the terminal end portion of the electric wire line may be electrically connected to a relay terminal, and the relay terminal may be electrically connected to the terminal, and may be insert-molded in the housing.

According to the configuration described above, there can be provided the connector capable of absorbing tolerance at the time of fitting and being reduced in size.

DETAILED DESCRIPTION

Figure 1:
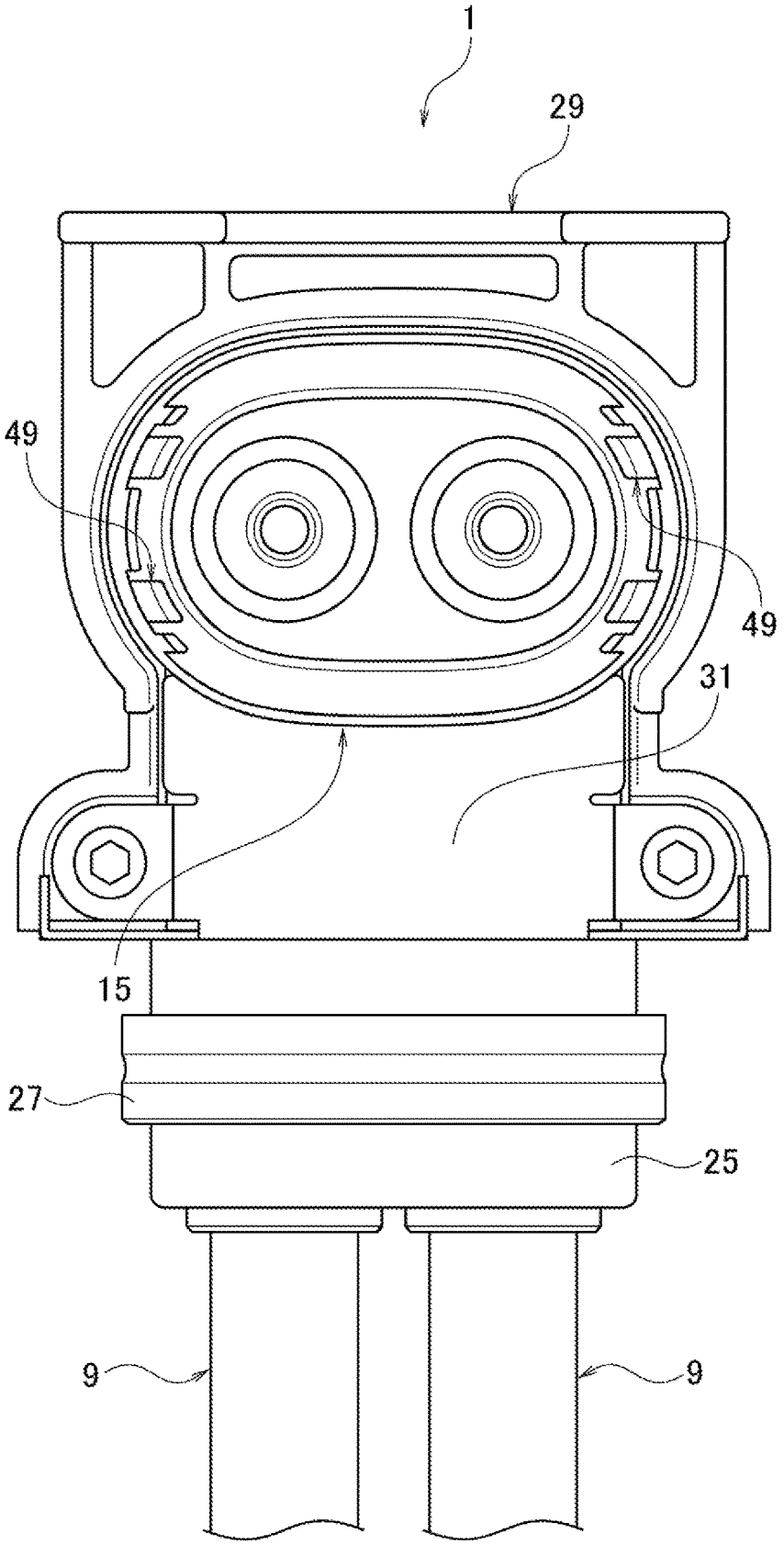
FIG. 1 is a front view of a connector according to the present embodiment.

Now, with reference to the drawings, a connector according to the present embodiment is described in detail. Note that a dimension ratio of the drawings is given in an exaggerated manner for convenience of the description, and is different from the actual ratio in some cases.

A connector 1 according to the present embodiment includes a housing 3 and a terminal 7. The housing 3 is fittable to a mating housing that houses a mating terminal The terminal 7 is housed in the housing 3, and includes a tubular electric connection portion 5 into which the mating terminal is inserted. Further, the connector 1 includes an electric wire line 9 that includes at least a terminal end portion housed in the housing 3 and is electrically connected to the terminal 7.

The electric connection portion 5 houses a multi-contact coil spring 11 that is formed to have an elastically-deformable annular shape, is electrically connected to the electric connection portion 5, and is brought into contact at a plurality of positions with the mating terminal inserted thereinto. Further, the terminal 7 and at least the terminal end portion of the electric wire line 9 are insert-molded in the housing 3.

A holding member 15 including a holding portion 13 is assembled to the housing 3. The holding portion 13 is inserted into the electric connection portion 5, and holds the multi-contact coil spring 11 in the electric connection portion 5.

The electric wire line 9 is drawn out from the housing 3 in a direction intersecting with a fitting direction of the housing 3, and the terminal end portion of the electric wire line 9 is electrically connected to a relay terminal 17. Further, the relay terminal 17 is electrically connected to the terminal 7, and is insert-molded in the housing 3.

As illustrated in FIG. 1 to FIG. 4, the connector 1 includes the housing 3, the terminal 7, the electric wire line 9, the relay terminal 17, the multi-contact coil spring 11, and the holding member 15.

Figure 2:
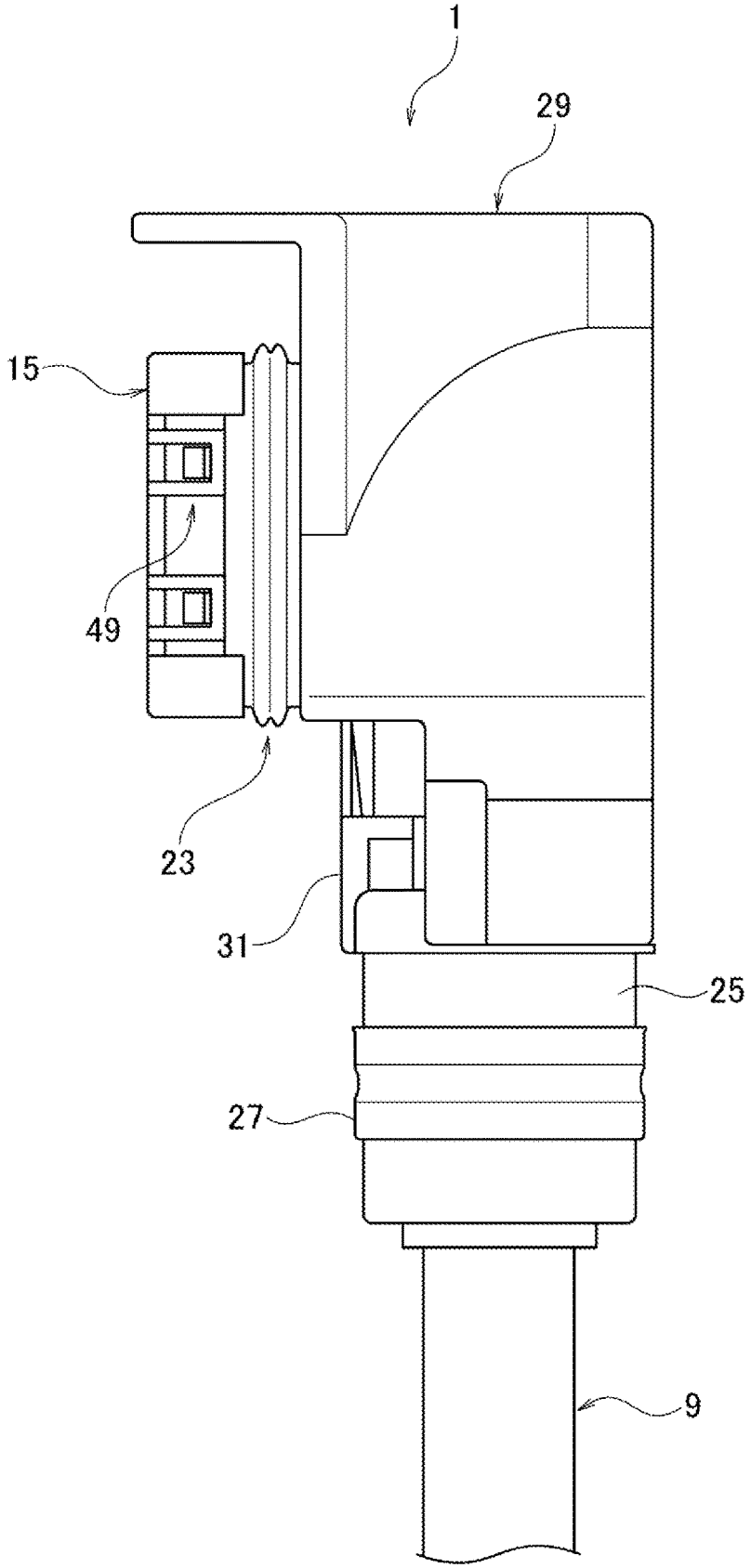
FIG. 2 is a side view of the connector according to the present embodiment.
Figure 3:
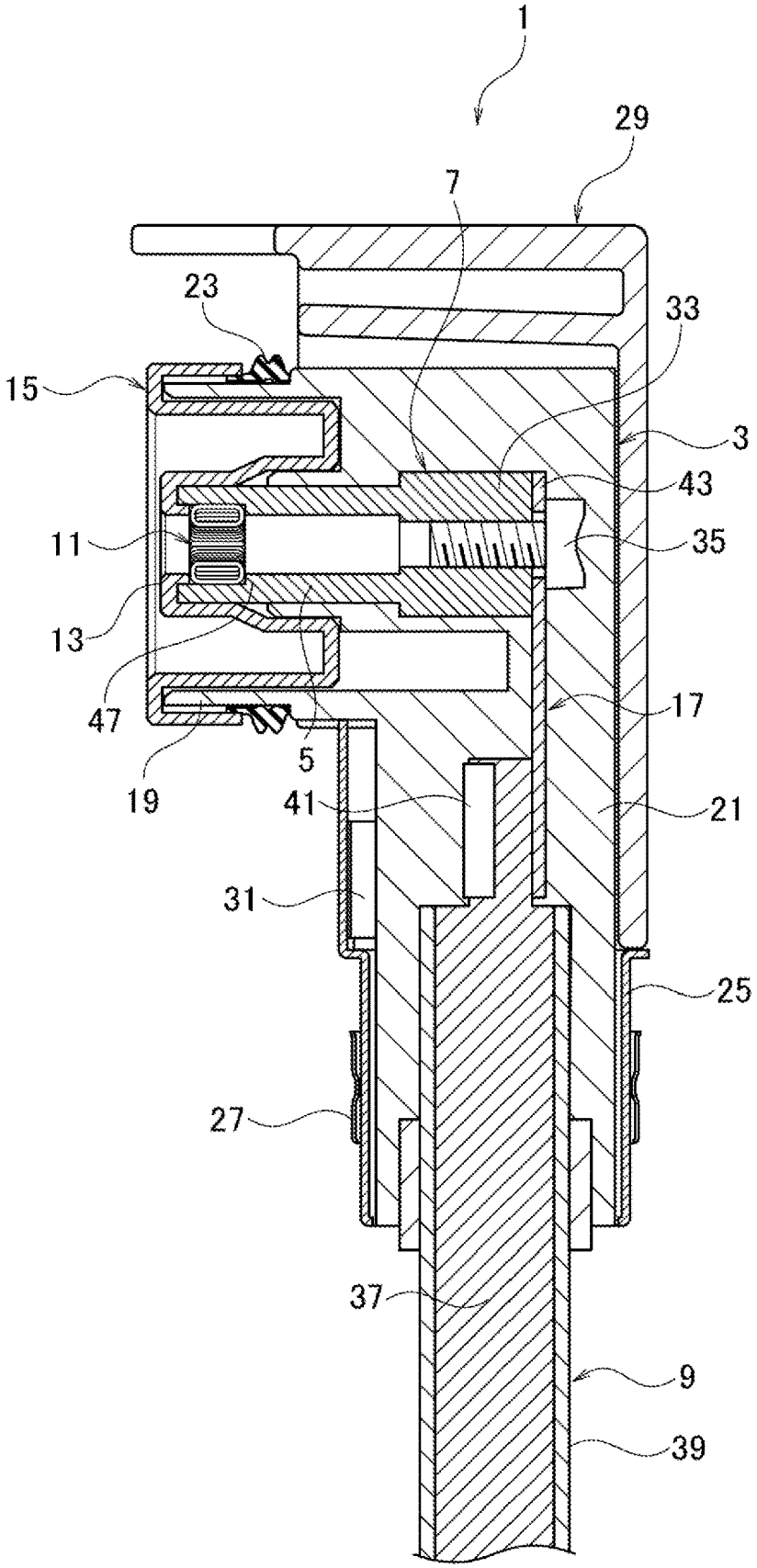
FIG. 3 is a sectional view of the connector according to the present embodiment.

As illustrated in FIG. 1 to FIG. 3, the housing 3 is formed of an insulating material such as synthetic resin, and includes a fitting portion 19 and an electric wire line drawing portion 21.

The fitting portion 19 is formed to have an oval tubular shape, and the mating housing (not shown) including the mating terminal (not shown) is fittable internally and externally thereto. A sealing member 23 is arranged around an outer circumference of the fitting portion 19, and exerts a waterproof effect between the mating housing and the housing 3 under a fitting state with the mating housing. A part of the electric connection portion 5 of the terminal 7, which is exposed from the housing 3, is arranged inside the fitting portion 19.

The electric wire line drawing portion 21 is a member continuous to the fitting portion 19, and is provided to extend in a direction orthogonal to the fitting direction of the fitting portion 19, which is a drawing direction of the electric wire line 9. A shielding member 25 is fixed to an outer circumference of the electric wire line drawing portion 21 through intermediation of a clamping ring 27, and prevents noise from entering the electric wire line 9 or noise from leaking from the electric wire line 9. At an end portion of the electric wire line drawing portion 21, the electric wire line 9 electrically connected to the terminal 7 is drawn outside of the housing 3.

Insert-molding takes place in the housing 3 so that the terminal 7, the terminal end portion of the electric wire line 9, and the relay terminal 17 are arranged inside, and the fitting portion 19 and the electric wire line drawing portion 21 are formed. Note that a protection cover 29 is assembled to an outer circumference of the housing 3 through intermediation of a fixing member 31, and protects the housing 3 or the mating housing. However, when not necessary, the protection cover 29 may be removed.

As illustrated in FIG. 3, a plurality of (in this case, two) terminals 7, which are formed of a conductive material, are arranged in the housing 3, and each include the electric connection portion 5 and an electric wire line-side connection portion 33.

The electric connection portion 5 is formed to have a tubular shape. The electric connection portion 5 is partially exposed outside of the housing 3 where insert-molding takes place, and is arranged in the fitting portion 19 of the housing 3. Under a state in which the housing 3 and the mating housing are fitted to each other, an electric connection portion, which is formed to have a rod-like shape, of the mating terminal housed in the mating housing is inserted into the electric connection portion 5.

The electric wire line-side connection portion 33 is a member continuous to the electric connection portion 5, and is formed to have a tubular shape having a thickness and a diameter that are larger than those of the electric connection portion 5. The entire electric wire line-side connection portion 33 is insert-molded in the housing 3. An inner circumference of the electric wire line-side connection portion 33 is formed to have a screw shape so that a bolt 35 can be fastened thereto.

As illustrated in FIG. 1 to FIG. 3, a plurality of (in this case, two) electric wire lines 9, each of which is formed of a coated electric wire line obtained by coating an outer circumference of a core wire portion 37 with an insulating coating portion 39, are arranged in accordance with the plurality of terminals 7. The electric wire line 9 has an end portion that is drawn out from the electric wire line drawing portion 21 of the housing 3, and the end portion is electrically connected to a power source, a device, or the like. At the terminal end portion of the electric wire line 9, the relay terminal 17 is electrically connected to the core wire portion 37 exposed from the insulating coating portion 39. On the terminal end portion side to which the relay terminal 17 is electrically connected, the electric wire line 9 is insert-molded in the housing 3, and is drawn out outside from the electric wire line drawing portion 21 of the housing 3.

As illustrated in FIG. 3, the relay terminal 17 is formed of a conductive material, the entirety thereof is insert-molded in the housing 3, and includes an electric wire line connection portion 41 and a terminal connection portion 43.

The electric wire line connection portion 41 is formed of a clamped piece being clamped by the core wire portion 37 of the electric wire line 9. The electric wire line connection portion 41 is clamped by the core wire portion 37 of the electric wire line 9, and hence causes the relay terminal 17 and the electric wire line 9 to be electrically connected to each other.

The terminal connection portion 43 is a member continuous to the electric wire line connection portion 41, and is formed to have a plate-like shape. A through hole into which the bolt 35 can be inserted is formed in the terminal connection portion 43. When the bolt 35 passes through the through hole, and is fastened to the electric wire line-side connection portion 33 of the terminal 7, the terminal connection portion 43 causes the terminal 7 and the electric wire line 9 to be electrically connected to each other through intermediation of the relay terminal 17.

Here, assume that the terminal 7 and the electric wire line 9 are electrically connected to each other in a direct manner without intermediation of the relay terminal 17. In this case, a state in which the electric wire line 9 is bent at an angle of approximately 90 degrees is obtained inside the housing 3. Thus, even when the bent portion of the electric wire line 9 is insert-molded in the housing 3, a large load is applied to the bent portion of the electric wire line 9.

In order to absorb tolerance at a contact portion between the terminal 7 and the mating terminal, for example, the electric wire line 9 is largely peeled, and the electric wire line 9 is routed in an arc. With this, a braided wire line can be interposed between the terminal 7 and the electric wire line 9. However, with this configuration, it is required to provide, inside the housing 3, a space in which the arc routing part of the electric wire line 9 and the braided wire line can move. This disadvantageously increases a size of the housing 3.

In view of this, when the terminal 7 and the electric wire line 9 are electrically connected to each other through intermediation of the relay terminal 17, it is not required to provide the bent portion to the electric wire line 9, and a large load is not applied to the electric wire line 9. Note that the drawing direction of the electric wire line 9 is not limited to the direction orthogonal to the fitting direction, and may be any drawing direction as long as the drawing direction intersects with the fitting direction. In this case, the connection portion between the electric wire line connection portion 41 and the terminal connection portion 43 of the relay terminal 17 may be bent in accordance with the drawing direction of the electric wire line 9.

Further, the terminal 7 and the electric wire line 9 are electrically connected to each other through intermediation of the relay terminal 17, and hence it is not required to provide, inside the housing 3, a space in which the arc routing part of the electric wire line 9 and the braided wire line can move. Thus, the housing 3 can be reduced in size.

The multi-contact coil spring 11 is housed in the electric connection portion 5 of the terminal 7, which is electrically connected to the electric wire line 9 through intermediation of the relay terminal 17 as described above.

Figure 4:
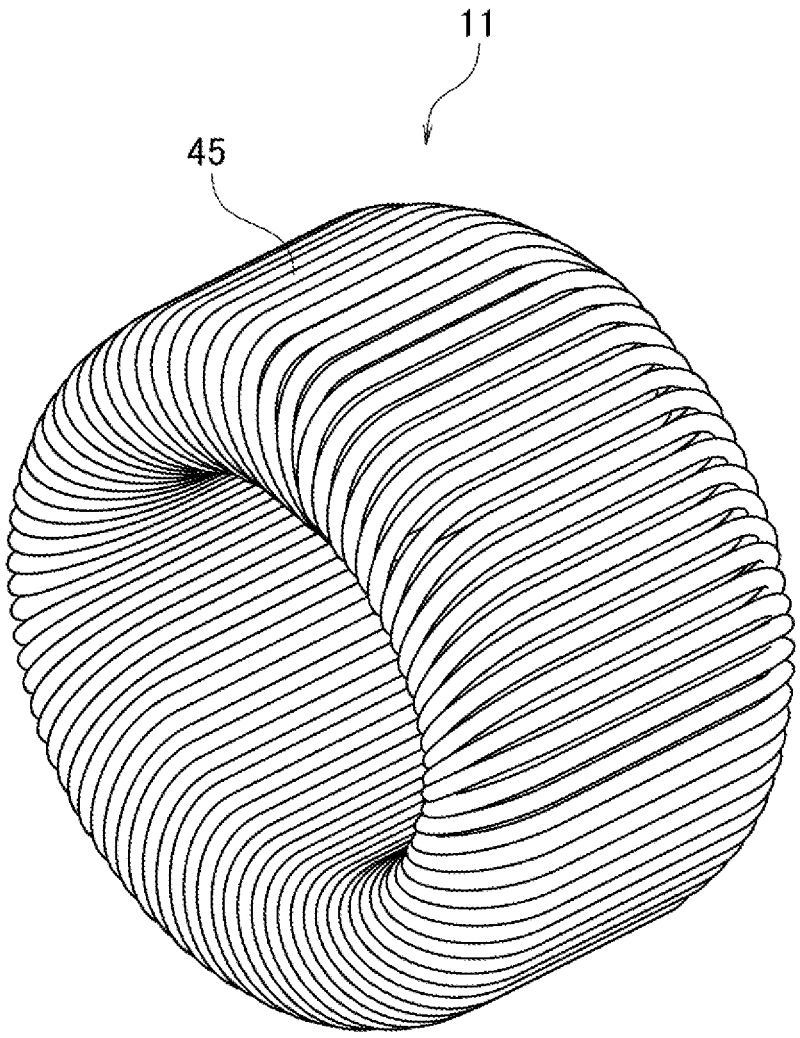
FIG. 4 is a perspective view of a multi-contact coil spring of the connector according to the present embodiment.

As illustrated in FIG. 3 and FIG. 4, the multi-contact coil spring 11 is formed to have an elastically-deformable annular shape by subjecting a plurality of linear members 45, which are formed of a conductive material, to bending, welding, or the like. On an inner circumferential surface and an outer circumferential surface of the multi-contact coil spring 11, the plurality of linear members 45 generate a state in which a plurality of contact portion extend in the fitting direction of the housing 3, and are arranged in a plurality of rows in the circumferential direction. The multi-contact coil spring 11, which is temporarily reduced in diameter, is inserted through an opening of the electric connection portion 5 under a state in which the terminal 7 is insert-molded in the housing 3, and is housed in the electric connection portion 5.

The multi-contact coil spring 11, which is housed in the electric connection portion 5 as described above, is brought into contact with an inner surface of the electric connection portion 5 due to an urging force with which the plurality of contact portions on the outer circumferential surface are restored. With this, the multi-contact coil spring 11 is electrically connected to the terminal 7. Note that, by abutting against a step portion 47 formed in the electric connection portion 5, the multi-contact coil spring 11 is prevented from moving into the electric connection portion 5. Further, the multi-contact coil spring 11 may be housed in the electric connection portion 5 before the terminal 7 is insert-molded in the housing 3.

Under a state in which the housing 3 and the mating housing are fitted to each other, the rod-like electric connection portion of the mating terminal is inserted so that the inner circumferential surface of the multi-contact coil spring 11 is pressed outward in the radial direction. Under a state in which the mating terminal is inserted, the plurality of contact portions on the inner circumferential surface of the multi-contact coil spring 11 are brought into contact with an outer surface of the mating terminal due to the urging force for restoration. With this, the terminal 7 and the mating terminal are electrically connected to each other through intermediation of the multi-contact coil spring 11.

By using the multi-contact coil spring 11 that is elastically deformable, tolerance at the time of fitting the housing 3 and the mating housing to each other can be absorbed, and the terminal 7 and the mating terminal can be electrically connected to each other in a stable manner. Thus, it is not required to provide, inside the housing 3, a structure for absorbing tolerance, and hence the housing 3 is not increased in size.

Further, the multi-contact coil spring 11 has a number of contact points with the mating terminal. Thus, even when a load therebetween with the mating terminal is low, low resistance can be obtained. Note that the multi-contact coil spring 11 of the present embodiment is formed to have a shape with depth in the fitting direction of the housing 3. When the multi-contact coil spring 11 is formed to have a shape elongated in the fitting direction as described above, a contact area with the mating terminal can be increased. Note that the multi-contact coil spring 11 is not limited to an oval coiled shape with depth in the fitting direction, and may have a round coiled shape.

The holding member 15 assembled to the housing 3 holds an arrangement position of the multi-contact coil spring 11 in the electric connection portion 5.

As illustrated in FIG. 1 to FIG. 3, the holding member 15 is formed to have a shape capable of covering an outer circumferential surface and an inner circumferential surface of the fitting portion 19 of the housing 3, and is assembled to the housing 3 through intermediation of a plurality of engagement portions 49. The holding member 15 is provided with the holding portion 13 that is inserted into the electric connection portion 5 of the terminal 7, abuts against the multi-contact coil spring 11, and holds the multi-contact coil spring 11 in the electric connection portion 5. The holding portion 13 holds the multi-contact coil spring 11, and hence the multi-contact coil spring 11 can be held at the regular position in the electric connection portion 5 while preventing the multi-contact coil spring 11 from falling off from the electric connection portion 5.

Therefore, under a state in which the multi-contact coil spring 11 is brought into contact with the mating terminal, the multi-contact coil spring 11 is prevented from moving in the electric connection portion 5, and electric connection reliability between the multi-contact coil spring 11 and the mating terminal can be maintained. Further, when the holding member 15 is removed from the housing 3, the multi-contact coil spring 11 can be removed from the inside of the electric connection portion 5, and the multi-contact coil spring 11 can be replaced easily.

Note that the holding member 15 is formed of a conductive material, and also functions as a shielding member that prevents noise from entering the terminal 7 or the mating terminal or noise from leaking from the terminal 7 or the mating terminal.

In the connector 1, the electric connection portion 5 houses the multi-contact coil spring 11 that is formed to have an elastically-deformable annular shape, is electrically connected to the electric connection portion 5, and is brought into contact at the plurality of positions with the mating terminal inserted thereinto.

Therefore, the multi-contact coil spring 11 that is elastically deformable can absorb tolerance at the time of fitting the housing 3 and the mating housing to each other, and the terminal 7 and the mating terminal can be electrically connected to each other through intermediation of the multi-contact coil spring 11 in a stable manner. Therefore, it is not required to provide a housing member that accommodates the housing 3, and at the same time, it is not required to provide a tolerance absorption structure therebetween with the housing member. With this, the connector 1 can be reduced in size. In addition, it is not required to provide a tolerance absorption structure inside the housing 3, and hence the connector 1 can be reduced in size.

Further, the terminal 7 and at least the terminal end portion of the electric wire line 9 are insert-molded in the housing 3. Thus, it is not required to provide the housing 3 with a structure for holding the terminal 7 and the electric wire line 9. With this, the housing 3 can be reduced in size, and hence the connector 1 can be reduced in size.

Thus, in the connector 1, the electric connection portion 5 houses the multi-contact coil spring 11, the terminal 7 and at least the terminal end portion of the electric wire line 9 are insert-molded in the housing 3. With this, tolerance at the time of fitting can be absorbed, and size reduction can be achieved.

Further, the holding member 15 including the holding portion 13 is assembled to the housing 3. The holding portion 13 is inserted into the electric connection portion 5, and holds the multi-contact coil spring 11 in the electric connection portion 5. Thus, the multi-contact coil spring 11 can be held stable in the electric connection portion 5, and connection reliability between the multi-contact coil spring 11 and the mating terminal can be maintained.

In addition, the electric wire line 9 is drawn out from the housing 3 in the direction intersecting with the fitting direction of the housing 3, and the terminal end portion of the electric wire line 9 is electrically connected to the relay terminal 17. Further, the relay terminal 17 is electrically connected to the terminal 7, and is insert-molded in the housing 3.

Therefore, it is not required to provide the bent portion to the electric wire line 9 due to the relay terminal 17, and a load applied to the electric wire line 9 can be suppressed. Further, it is not required to provide the housing 3 with a structure for holding the relay terminal 17, and hence the housing 3 can be reduced in size.

Next, a comparative example is described. A connector according to the comparative example includes a sub-housing and a terminal. The sub-housing is a housing fittable to a mating housing that houses a mating terminal. The terminal is housed in the sub-housing, and includes a tubular electric connection portion into which the mating terminal is inserted. The connector includes an electric wire line that includes at least a terminal end portion housed in the sub-housing and is electrically connected to the terminal.

In the connector according to the comparative example, the sub-housing is accommodated in a frame. An alignment means is provided between the sub-housing and the frame, and is capable of moving the sub-housing in the frame in a plane direction orthogonal to a fitting direction to the mating housing.

In the connector according to the comparative example, in a case where the sub-housing and the mating housing are fitted to each other, when tolerance is present between the sub-housing and the mating housing, the alignment means moves the sub-housing. This movement of the sub-housing absorbs tolerance at the time of fitting, enables the sub-housing and the mating housing to be fitted normally to each other, and enables the terminal and the mating terminal to be electrically connected to each other in a stable manner.

However, in order to absorb tolerance at the time of fitting, in the connector according to the comparative example, the housing is accommodated in the frame, and the alignment means is provided between the housing and the frame. Thus, the tolerance absorption structure requires the frame larger than the housing, which disadvantageously increases a size of the connector as a whole.

The present embodiment is described above. However, the present embodiment is not limited thereto, and various modifications may be made without departing from the gist of the present embodiment.

For example, the electric wire line is drawn out from the housing in the direction intersecting the fitting direction of the housing, but the electric wire line may be drawn out from the housing in a direction parallel to the fitting direction of the housing. In this case, the terminal and the electric wire line may be electrically connected to each other in a direct manner without intermediation of the relay terminal.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A connector, comprising:

a housing fittable to a mating housing that houses a mating terminal;

a terminal being housed in the housing and including an electric connection portion into which the mating terminal is inserted, the electric connection portion being tubular; and an electric wire line including at least a terminal end portion housed in the housing and being electrically connected to the terminal, wherein the electric connection portion houses a multi-contact coil spring that is formed to have an elastically-deformable annular shape, is electrically connected to the electric connection portion, and is brought into contact at a plurality of positions with the mating terminal inserted thereinto, the terminal and at least the terminal end portion of the electric wire line are insert-molded in the housing, and wherein a holding member including a holding portion is assembled to the housing, the holding portion being inserted into the electric connection portion and holding the multi-contact coil spring in the electric connection portion.

2. The connector according to claim 1, wherein the electric wire line is drawn out from the housing in a direction intersecting with a fitting direction of the housing, the terminal end portion of the electric wire line is electrically connected to a relay terminal, and the relay terminal is electrically connected to the terminal, and is insert-molded in the housing.

3. The connector according to claim 1, wherein the housing is formed of an insulating material and the holding member is formed of a conductive material.

4. The connector according to claim 1, wherein a shielding member is fixed to an outer circumference of the electric wire line drawing portion.

5. The connector according to claim 1, wherein the housing comprises a fitting portion with a tubular shape and configured to fit with the mating terminal, the fitting portion is provided with a sealing member configured to be attached on an outer circumference of the fitting portion, and the holding member is configured to cover the outer circumference of the fitting portion and configured to be in contact with the sealing member on the fitting portion when the holding member is assembled to the housing.

* * * * *